US011273973B2

(12) United States Patent
Holford

(10) Patent No.: US 11,273,973 B2
(45) Date of Patent: Mar. 15, 2022

(54) PACK WITH A LID FRONT WALL FLAP

(71) Applicant: British American Tobacco (Investments) Limited, London (GB)

(72) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 16/963,573

(22) PCT Filed: Jan. 21, 2019

(86) PCT No.: PCT/GB2019/050154

§ 371 (c)(1),
(2) Date: Jul. 21, 2020

(87) PCT Pub. No.: WO2019/145689

PCT Pub. Date: Aug. 1, 2019

(65) Prior Publication Data

US 2021/0053746 A1 Feb. 25, 2021

(30) Foreign Application Priority Data

Jan. 26, 2018 (GB) ..... 1801347

(51) Int. Cl.
*B65D 85/10* (2006.01)

(52) U.S. Cl.
CPC ... *B65D 85/10568* (2020.05); *B65D 85/1045* (2013.01); *B65D 85/1081* (2013.01)

(58) Field of Classification Search
CPC ..... B65D 85/10; B65D 85/1045; B65D 85/1056; B65D 85/10568; B65D 85/1081
(Continued)

(56) References Cited

U.S. PATENT DOCUMENTS 5,363,955 A 11/1994 Fleenor
5,478,011 A 12/1995 Pham
(Continued)

FOREIGN PATENT DOCUMENTS

DE 202015106399 U1 1/2017
DE 102015013734 A1 4/2017
(Continued)

OTHER PUBLICATIONS

British Search Report for corresponding application GB1801342.5; Report dated Jul. 17, 2018.
(Continued)

*Primary Examiner* — Bryon P Gehman
(74) *Attorney, Agent, or Firm* — Cantor Colburn LLP

(57) ABSTRACT

A pack comprising a base containing a group of tobacco industry products wrapped in a barrier layer that comprises a section to define an extraction opening for the removal of tobacco industry products when the pack is open is disclosed. The pack has a lid attached to the base for rotation between open and closed positions and a lid front wall having an inner surface. A lid front wall flap is folded relative to the lid front wall. A label is attached to said section and has a portion attached to the lid so that, when the lid is rotated into an open position, the section is lifted to open the extraction opening. The lid front wall flap is shaped so that the portion of the label is attached to the inner surface of the lid front wall rather than to the lid front wall flap.

18 Claims, 12 Drawing Sheets

(58) Field of Classification Search
USPC ..... 206/245, 268
See application file for complete search history.

(56) References Cited

U.S. PATENT DOCUMENTS

| | | | |
|---|---|---|---|
| 5,934,461 | A | 8/1999 | Fleenor |
| 9,499,331 | B2 | 11/2016 | Seyfferth De Oliveira |
| 9,815,613 | B2 | 11/2017 | Seyfferth De Oliveira |
| 10,633,169 | B2 | 4/2020 | Buse |
| 2008/0020681 | A1 | 8/2008 | Spatafora |
| 2014/0374290 | A1 | 12/2014 | Seyfferth De Oliveira |
| 2015/0021219 | A1 | 1/2015 | Seyfferth De Oliveira |
| 2015/0374033 | A1 | 12/2015 | Pilzecker |
| 2015/0375923 | A1 | 12/2015 | Pilzecker |
| 2017/0113865 | A1 | 4/2017 | Swede |
| 2017/0203910 | A1 | 7/2017 | Buse |

FOREIGN PATENT DOCUMENTS

| | | | |
|---|---|---|---|
| DE | 102015016456 | A1 | 6/2017 |
| DE | 102016003737 | A1 | 10/2017 |
| EP | 0647571 | A1 | 4/1995 |
| EP | 3009374 | A1 | 4/2016 |
| GB | 461794 | | 2/1937 |
| JP | 1149151 | A | 2/1999 |
| KR | 1020140022366 | A | 2/2014 |
| WO | 2007093288 | A1 | 8/2007 |
| WO | 2008142540 | A1 | 11/2008 |
| WO | 2012049701 | A2 | 4/2012 |
| WO | 2012095135 | A1 | 7/2012 |
| WO | 2012095372 | A1 | 7/2012 |
| WO | 2016059366 | A1 | 4/2016 |
| WO | 2016083608 | A1 | 6/2016 |
| WO | 2016087819 | A1 | 6/2016 |
| WO | 2016087826 | A1 | 6/2016 |
| WO | 2016120674 | A1 | 8/2016 |
| WO | 2016166692 | A1 | 10/2016 |
| WO | 2017072606 | A1 | 5/2017 |
| WO | 2017072730 | A1 | 5/2017 |
| WO | 2017072731 | A1 | 5/2017 |
| WO | 2017097999 | A1 | 6/2017 |
| WO | 2018002033 | A1 | 1/2018 |

OTHER PUBLICATIONS

British Search Report for corresponding application GB1801347.4; Report dated Jul. 17, 2018.

International Search Report for corresponding application PCT/GB2019/050135 filed Jan. 18, 2019; dated Apr. 4, 2019.

International Search Report for corresponding application PCT/GB2019/050154 filed Jan. 21, 2019; dated May 16, 2019.

Written Opinion for the International Searching Authority for corresponding application PCT/GB2019/050135 filed Jan. 18, 2019; dated Apr. 4, 2019.

Written Opinion of the International Searching Authority for corresponding application PCT/GB2019/050154 filed Jan. 21, 2019; dated May 16, 2019.

British Search Report for corresponding application GB1802166.7; Report dated Jun. 26, 2018.

International Search Report for corresponding application PCT/GB2019/050155 filed Jan. 21, 2019; dated Mar. 21, 2019.

Written Opinion of the International Searching Authority for corresponding application PCT/GB2019/050155 filed Jan. 21, 2019; dated Mar. 21, 2019.

PACK WITH A LID FRONT WALL FLAP

TECHNICAL FIELD

The present invention relates to a pack for tobacco industry products such as smoking articles, including cigarettes.

BACKGROUND

Smoking articles, such as cigarettes, are sold in packs. Packs often comprise an outer carton made from cardboard which has a base, a hinged lid and an inner frame protruding from and attached to the base that is received within the lid when the lid is closed. The base contains a bundle of smoking articles. The smoking articles are wrapped in a flexible barrier layer having an extraction opening to facilitate removal of a smoking article from the pack by a consumer when the lid is open.

The opening may be closed by a flexible label which extends over the extraction opening. The label may be attached to the lid such that it is peeled back to reveal the extraction opening when the lid has been pivoted into an open position and is resealed when the lid is rotated back into a closed position. The lid often comprises a flap extending from a bottom edge of a front wall of the lid which is folded about the bottom edge and attached to an inner surface of the lid front wall. This enables printing up to and around the bottom edge of the front wall of the lid.

SUMMARY

In accordance with some embodiments described herein, there is provided a pack comprising: a base containing a group of tobacco industry products wrapped in a barrier layer that comprises a section to define an extraction opening for the removal of tobacco industry products when the pack is open, a lid attached to the base for rotation between open and closed positions and comprising a lid front wall having an inner surface and a lid front wall flap folded relative to the lid front wall; and a label attached to said section and having a portion attached to the lid so that, when the lid is rotated into an open position, the removable section is lifted to open the extraction opening, wherein the lid front wall flap is shaped so that the portion of the label is attached to the inner surface of the lid front wall rather than to the lid front wall flap.

The lid can comprise facing side walls separated by the lid front wall and the portion of the label attached to the lid may comprise a tab having a width which is less than a width of the lid front wall extending between the facing side walls.

The tab may be at least partially surrounded by the lid front wall flap. The tab can be attached to the inner surface of the lid front wall so that a portion of the lid front wall flap extends between the tab and each facing side wall.

The tab may be completely surrounded by the lid front wall flap. The pack may comprise an aperture in the lid front wall flap and the portion of the label can be attached to the inner surface of the lid front wall through the aperture. It can also be appreciated that the pack may comprise a series of apertures in the lid front wall flap, in which case the label can be attached to the inner surface through each aperture.

The pack may comprise a recess extending from an edge of the lid front wall flap, the tab being received in the recess and attached to the inner surface of the lid front wall. The tab may be attached to the inner surface of the lid front wall so that a portion of the lid front wall flap extends between the tab and each facing side wall.

Alternatively, the tab can be received in the recess and may be attached to the inner surface of the lid front wall so that a portion of the tab extends between the lid front wall flap and each facing side wall.

The label may comprise an inner surface attached to the section, and an outer face of the label, formed by the tab, can be attached to the lid.

The tab may also be separated from the remainder of the label by a fold-line. An inner face of the label may be attached to the section and also to the lid.

The base and lid of the pack may be integrally formed and, they may both be formed from a sheet of board having a metallised, or other type, of surface layer. An opposing surface of the board may not have a metallised surface layer, and the inner surface of the lid front wall to which the label is attached is said opposing surface.

In accordance with some embodiments described herein, there is provided a pack comprising: a base containing a group of tobacco industry products wrapped in a barrier layer that comprises a section to define an extraction opening for the removal of tobacco industry products from the bundle when the pack is open, a lid attached to the base for rotation between open and closed positions and comprising a lid front wall having an inner surface and a lid front wall flap having front and rear faces, the lid front wall flap being folded relative to the lid front wall about a fold extending along a lower edge of the lid front wall, and comprising a first portion extending from said fold, the rear face of the lid front wall flap formed by the first portion being attached to said inner surface of the lid front wall; the lid front wall flap comprising a second portion extending from an edge of the first portion and which is folded back relative to the first portion to expose the rear face of the lid front wall flap formed by the second portion, and a label attached to said section and having a portion attached to the lid so that, when the lid is rotated into an open position, the section is lifted to open the extraction opening.

The first and second portions of the lid front wall flap may be releasably or permanently, attached to each other.

The lid front wall flap may comprise an intermediate portion extending from the first portion for rotation relative to the first portion about a fold, and the second portion may extend from the intermediate portion for rotation relative to the intermediate portion about a further fold.

The base and lid can be formed from a sheet of board material having a metallised surface layer. An opposing surface of the board may not have a metallised surface layer. The rear face of the lid front wall flap formed by the second portion to which the portion of the label is attached, may be the opposing surface.

In some embodiments, the lid front wall flap may extend over the portion of the label which is attached to the inner surface of the lid front wall.

The lid front wall flap may be attached to said portion of the label. The lid may comprise facing side walls separated by the lid front wall and the portion of the label attached to the lid may comprise a tab having a width which is less than a width of the lid front wall flap extending between the facing side walls.

The lid front wall flap may be attached to both the tab and to the lid front wall.

The label may comprise a peripheral portion that extends beyond the removable section, said peripheral portion being attached to the barrier layer with reuseable adhesive such that the peripheral portion of the label is peeled away from the barrier layer when the lid is opened and is repositioned to reseal the barrier material when the lid is closed.

The base and lid may be formed from a sheet of board material having one metallised surface that includes the front face of the lid front wall flap.

The barrier layer can be formed from a laminate material comprising first and second layers, the label being formed from the second layer.

The region that defines the extraction opening can be a part of the barrier layer which is attached to said label.

Prior to first opening the region can be attached to the remainder of the barrier layer by a line of weakness that breaks on first opening of the lid.

The label may comprise an inner surface attached to the removable section, and an outer face of the label can be attached to the lid. However it can be appreciated that the label may alternatively comprise an inner surface attached to the removable section and an inner face of the label may be attached to the lid.

It can be appreciated that the pack or the lid front wall flap may further contain any combination of features from the described embodiments.

BRIEF DESCRIPTION OF THE DRAWINGS

Embodiments of the invention will now be described, by way of example only, with reference to the accompanying drawings, in which.

DETAILED DESCRIPTION

Figure 1:
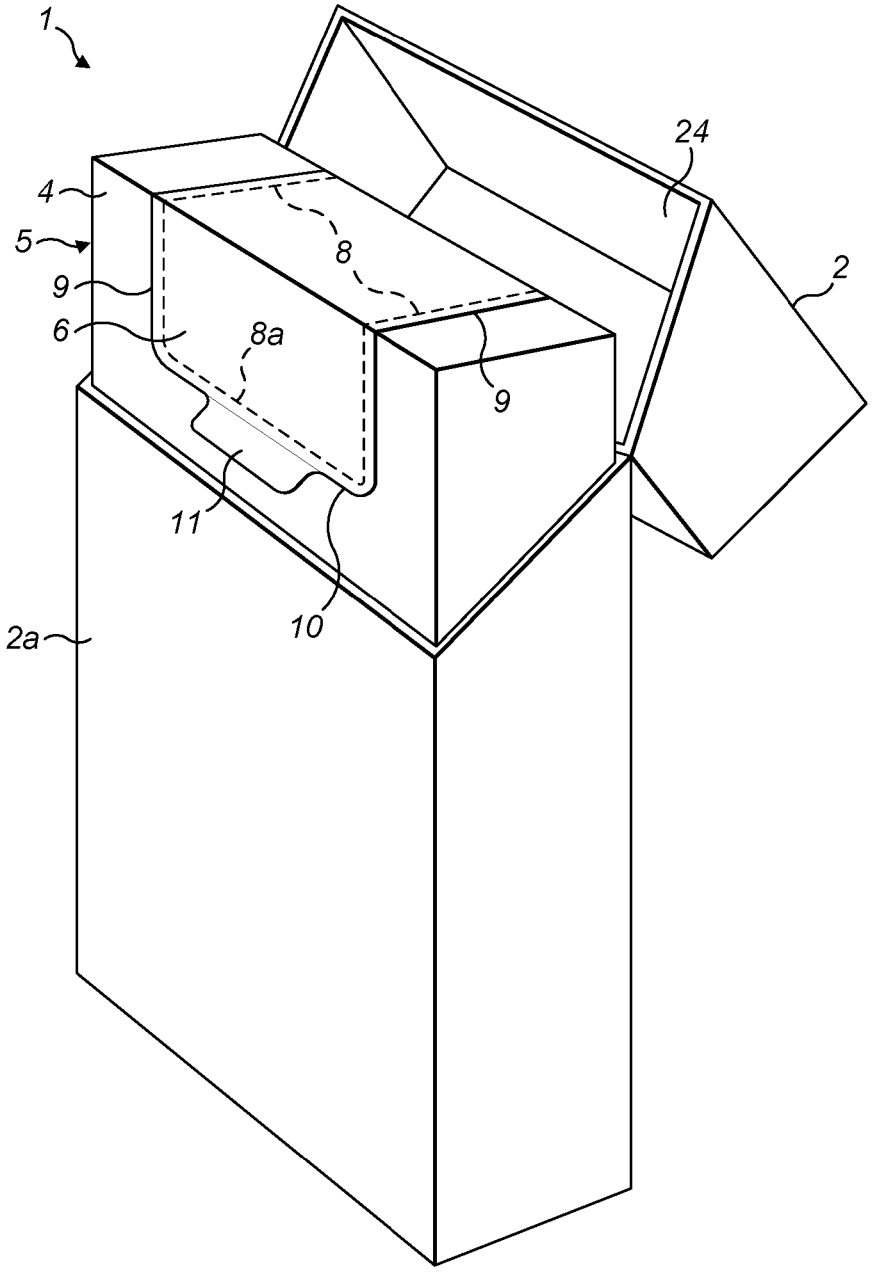
FIG. 1 shows a perspective view of an example pack, with its lid in an open position to reveal a wrapped bundle of smoking articles received within it, prior to peeling back of a label that covers an extraction opening.

FIG. 1 shows an example rigid card pack 1 with a hinged lid 2 and a base 2*a* containing a group of cigarettes 3 (see FIG. 2) wrapped in a barrier layer 4 to form a bundle 5. The bounds or edges 8 of an extraction opening 6 formed from a removable region 4*a* of the barrier layer for allowing access to the cigarettes 3 is indicated by dotted lines extending from the rearside of the barrier layer 4 across the top of the bundle 5 and down the front as far as a lower front wall extraction opening edge 8*a*. The barrier layer 4, which wraps about the cigarettes 3, may be made of metallized plastics or of a plastics/metal foil laminate. Over the extraction opening 6 lies a label 9, which is a layer of material having on its undersurface nearer to the barrier layer 4*a* re-stick adhesive which is of sufficient strength to ensure that the label 9 remains adhered to the removable region 4*a*. The re-stick adhesive covers the undersurface of the label 9. Alternatively, a permanent bonding adhesive may be applied to the portion of the undersurface of the label 9 which does not overlie the edges of the barrier layer 4, i.e. on the portion that overlies the removable region 4*a* of the barrier layer 4. However, where the label 9 extends beyond the edges 8 of the extraction opening 6, the undersurface is provided with re-stick adhesive.

To ensure good adhesion, an inner frame (not shown) may be provided within the bundle 5 so that it extends partially around the cigarettes 3 beneath the barrier layer 4. The inner frame provides a reaction surface underneath the barrier layer 4 against the resealing pressure exerted by the label 9 around the periphery of the extraction opening 6.

The label 9 has a lower front wall edge 10 and includes a tab 11 extending from the lower front wall edge 10 which is at least partly free of restick adhesive so that it may be used to peel back the label 9 in order to open the extraction opening 6.

Figure 2:
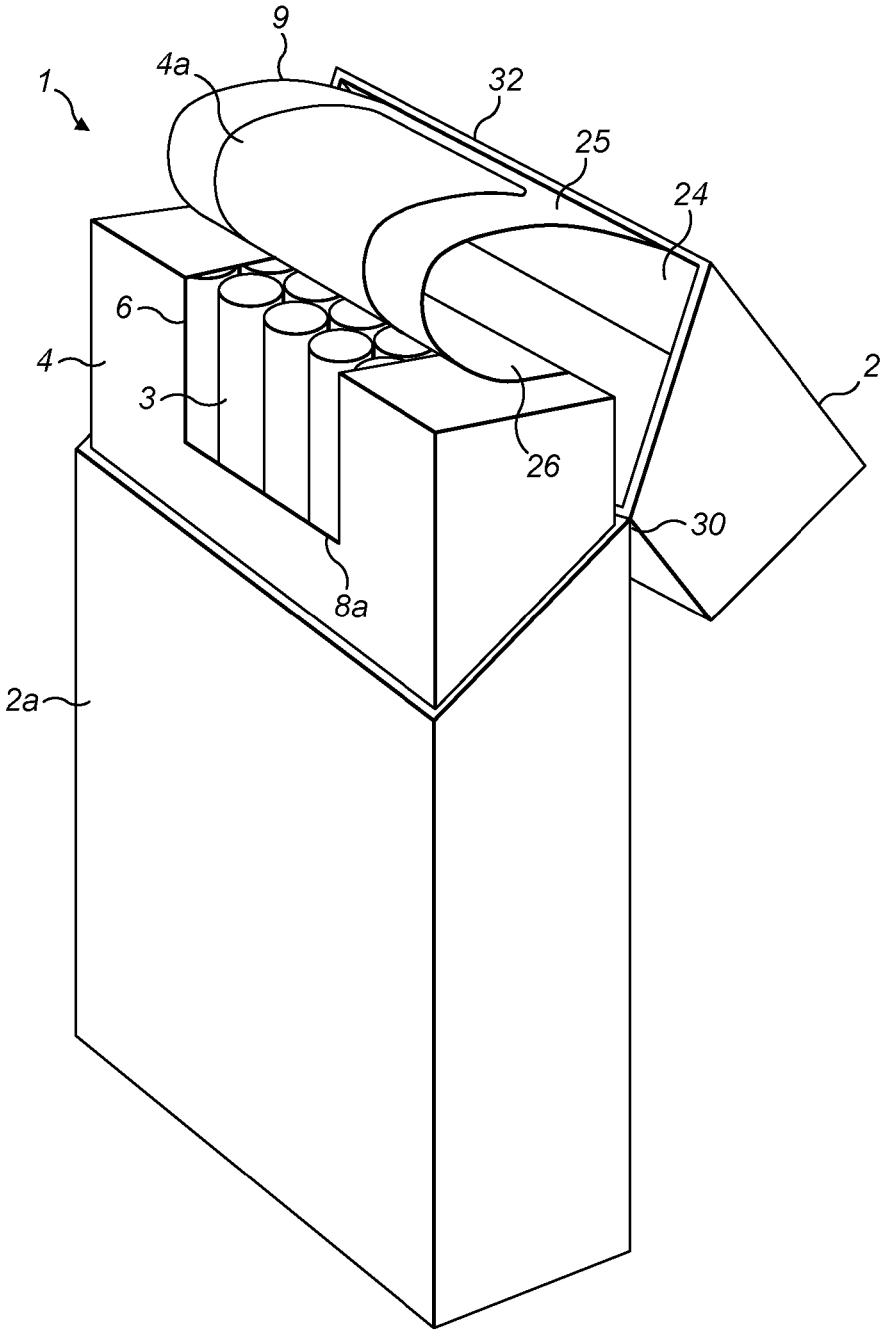
FIG. 2 shows a perspective view of a pack according to an embodiment of the invention with the lid open, and in which a lower edge or tab of the label is attached to the inner surface of the front wall of the lid so that the label peels back to reveal the extraction opening simultaneously with opening of the lid.

In an embodiment according to the invention, the lowermost edge, or tab 25, of the label 9 is attached to the front wall of the lid 2 so that the label is peeled back to reveal the extraction opening 6 at the same time the lid 2 is opened. In particular, with the lid 2 in an open position, as shown in FIG. 2, removable section 4*a* of the barrier layer 4 is drawn back to reveal the extraction opening 6 and to enable a consumer to readily extract a cigarette 3 from the bundle 5. Although reference is made to section 4*a* as being 'removable', it will be appreciated that it may remain at least partially attached to the remainder of the barrier layer when the extraction opening 6 is revealed.

Figure 3:
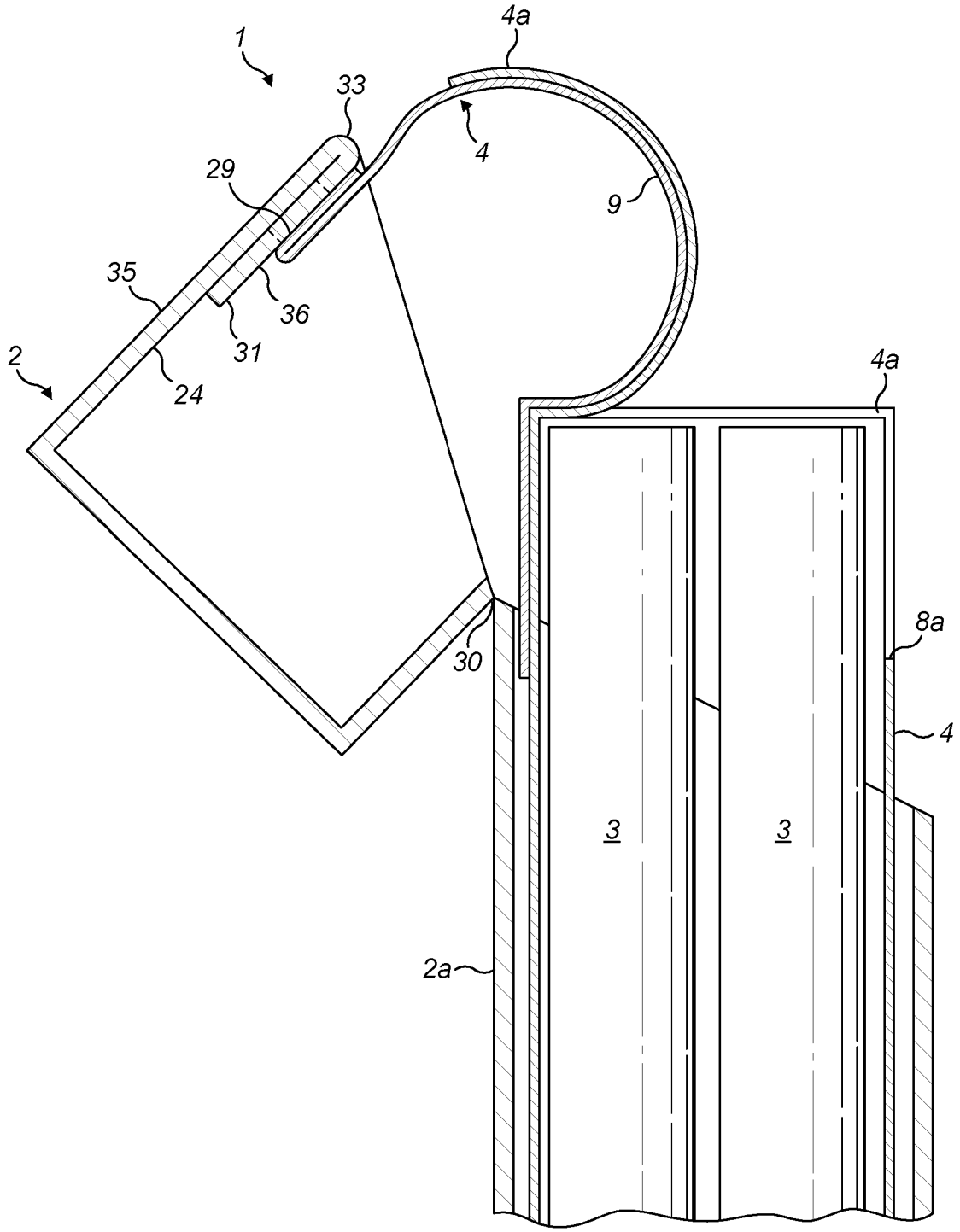
FIG. 3 shows a cross-sectional side elevation of an upper portion of the pack according to FIG. 3 with a flap extending from a bottom edge of the lid and folded inside the lid, the label configured so that it peels back to reveal the extraction opening simultaneously with opening of the lid.
Figure 4:
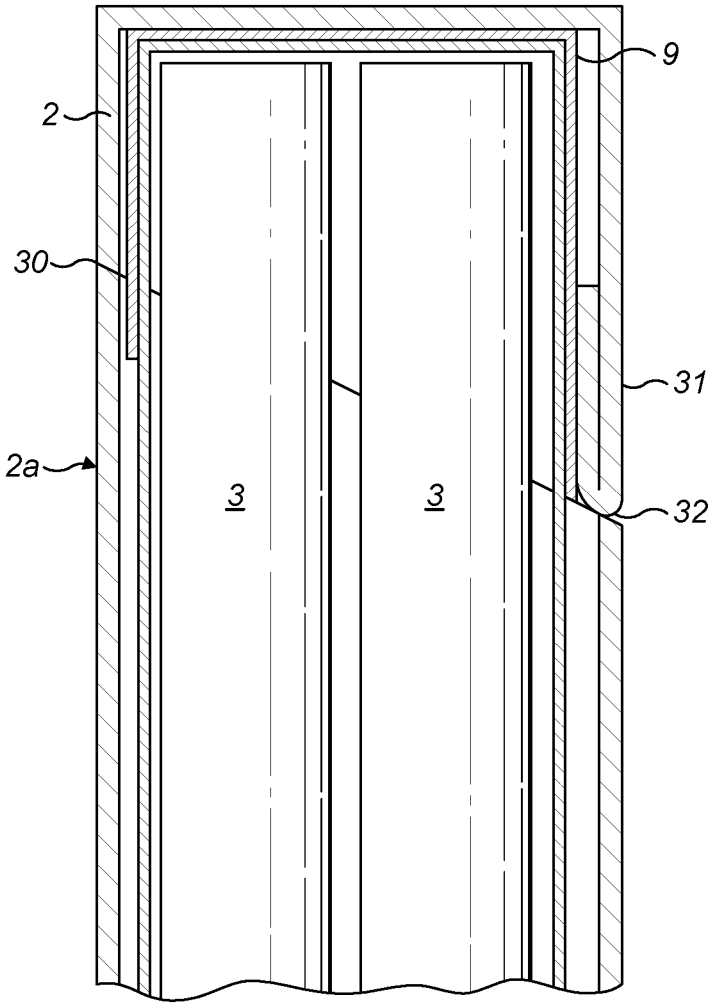
FIG. 4 shows a cross-sectional side elevation of an upper portion of a pack according to FIG. 3 with the lid closed.
Figure 14:
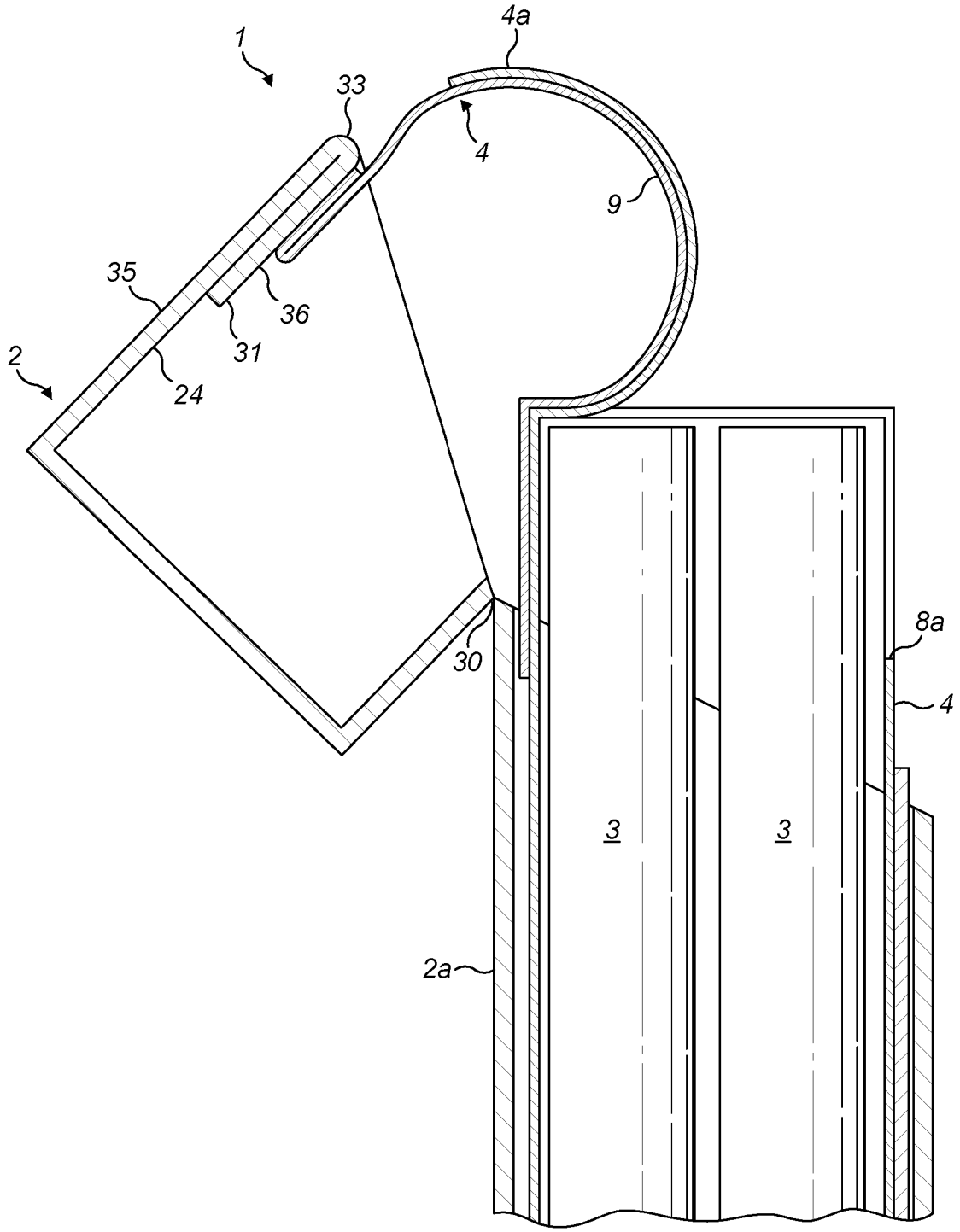
FIG. 14 shows a cross-sectional side elevation of an upper portion of the pack according to any of FIG. 3 to 10, where the label and the barrier are formed by a multi-layer laminate.
Figure 15:
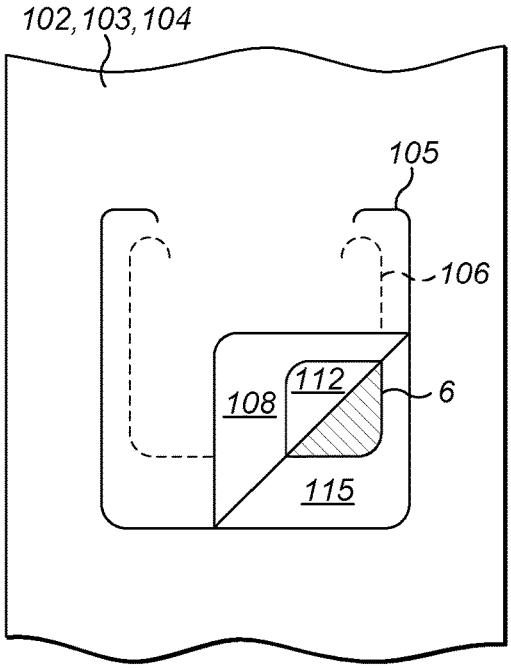
FIG. 15 shows a plan view of a label of FIG. 14 when laid flat.

To achieve simultaneous opening of the lid 2 and label 9, a portion of the outer surface of the label formed by the tab 25 is attached to the lid 2 using permanent adhesive so that the tab 25 folds back relative to the remainder of the label 9 when the lid 2 is rotated into an open position (see FIGS. 3 and 14).

When the lid 2 is pivoted about hinge 30 into its open position, the label 9 is pulled due to the connection between the tab 25 and the lid 2. This results in the label 9 being peeled back or rolled away from the barrier layer 4 with the section 4*a* of the barrier layer 4 being lifted away from the extraction opening 6 together with the label 9 to provide the extraction opening 6. If the pack 1 is being opened for the first time, then region 4*a* may also separate from the remainder of the barrier layer 4 along a line of weakening that separates region 4*a* from the remainder of the barrier layer 4, as the lid 2 is opened.

It will be appreciated that, when the lid 2 is rotated about the hinge 30 back into its closed position, the label 9 will roll back across the barrier material 4 and the removable region 4*a* of the barrier layer 4 will re-position itself within the extraction opening 6. The peelable adhesive coating the peripheral region of the label 9 will re-adhere to the barrier layer 4 surrounding the extraction opening 6 to reseal the pack 1.

The lid comprises a lid front wall flap 31 which extends from the lower edge 32 of the front wall of the lid 35. The lid front wall flap 31 is folded substantially 180 degrees about fold line 33 to lie against an inner front face 24 of the lid 2. The lid front wall flap 31 has a first edge 50 opposite fold line 33, a second side edge 51 and a third side edge 52, the second and third side edges 51, 52 extend parallel to each other. The lid 2 has an external surface 48 and an inner surface 49.

A rear face 28 of the lid front wall flap 31 is at least partially permanently adhered to the inner surface 49 of the lid 2 at the lid inner front face 24, the rear face 28 of the lid front wall flap 31 being positioned on the inner surface 49 against the lid inner front face 24 of the lid front wall 35 when folded. This folded flap 31 allows printing up to and around the lower edge 32 of a front wall 35 of the lid 2 around fold line 33. The tab 25 of the label 9 is adhered to the front face 36 of the lid front wall flap 31.

Some materials used for the construction of the pack, including the lid 2 and base 2*a*, can have a metallised, or otherwise coated, external surface layer which is the outer surface visible to a consumer. For example, the board material from which the lid and base are made may be Transmet board, which is a film-free metallic laminate for paperboard that provides a print receptive coating to the base material in a bright metallic finish. Transmet laminate is manufactured by the API Group. The metallised, or otherwise coated, surface can prevent or hinder adhesive from penetrating the material to form a good bond. It will be understood that, as a result of folding back the lid front wall flap 31, the metallised surface layer extends over the front face 36 of the lid front wall flap 31. As a result the label 9 may not adhere particularly well to the front face 36 of the lid front wall flap 31. Alternatively, the board material may be Metpol, which has a layer of metallisation coated with a polymer layer. This material would suffer from a similar problem to the Transmet board, as the external polymer layer is non-porous and so would not absorb adhesive.

Figure 6:
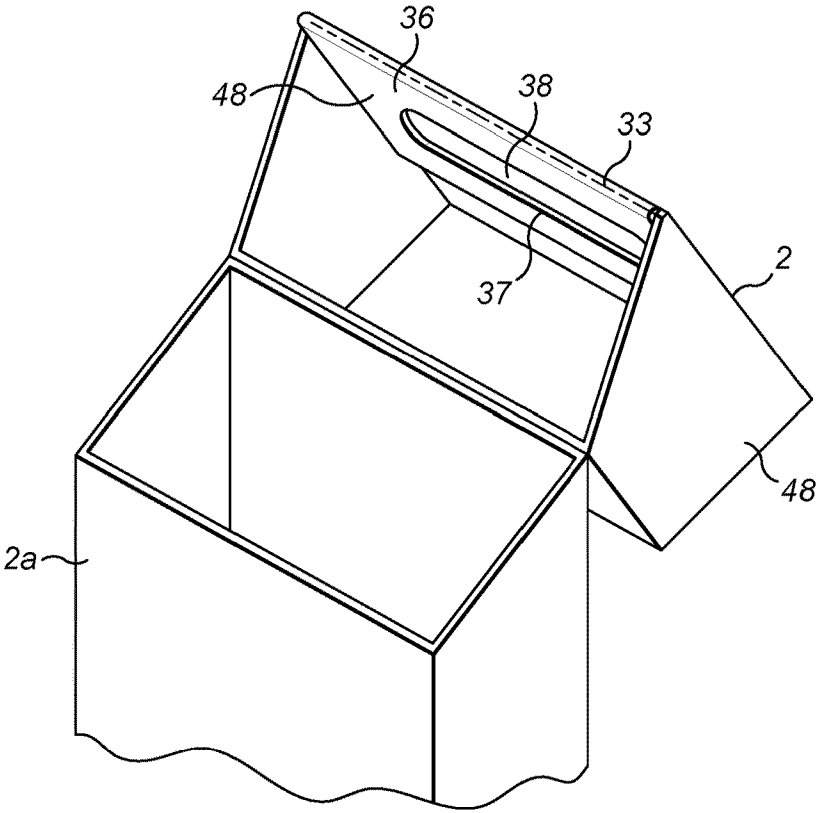
FIG. 6 shows a perspective view of a flap of FIG. 5 after the flap is folded about a bottom edge of the front wall of the lid.
Figure 5:
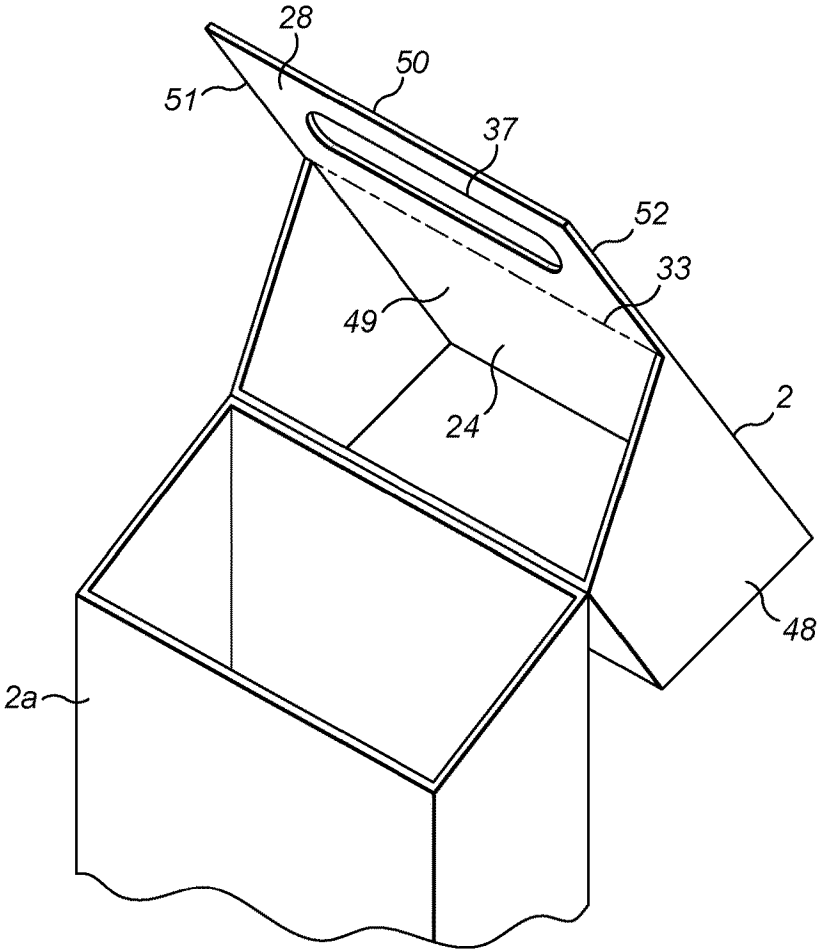
FIG. 5 shows a perspective view of a flap of FIG. 3 according to a first embodiment of the invention, comprising an aperture, before the flap is folded about a bottom edge of the front wall of the lid.

In a first embodiment of the invention, shown in FIGS. 5 and 6, the pack has been modified to include an aperture 37 through the lid front wall flap 31. The aperture ensures that an area of the inner surface 49 of the lid inner front face 24 remains exposed once the lid front wall flap 31 has been folded and adhered to the inner surface 49, as described above. The area of inner surface 49 exposed by the aperture 37 is referred to as the exposed inner surface 38. The label 9 is adhered to the exposed inner surface 38 of the lid 2 as opposed to the front face 36 of the lid front wall flap 31, thereby forming a better bond.

It can be appreciated that the flap could be adapted to include a number of apertures 37. This plurality of apertures can expose a plurality of areas 38 of the inner surface 49. The apertures may be axially aligned, regularly spaced or randomly located across the flap and the label 9 is adhered to the areas of exposed inner surface 38 across the inner surface 49 of the lid inner front face 24. It can also be envisaged that the aperture or apertures 37 can be of a number of alternative shapes to enable a portion of the label 9 to be attached to the area of inner surface 49 exposed by the aperture 37. If a single aperture 37 is provided, it may be centrally located between side edges 51, 52.

Figure 8:
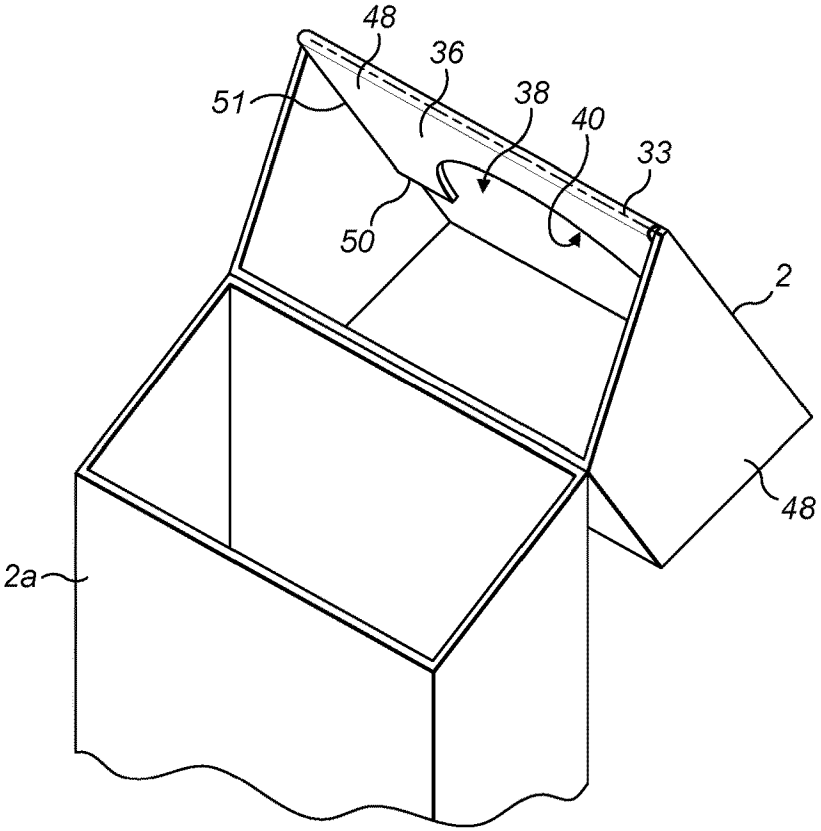
FIG. 8 shows a perspective view of a flap of FIG. 7 after the flap is folded about a bottom edge of the front wall of the lid.
Figure 7:
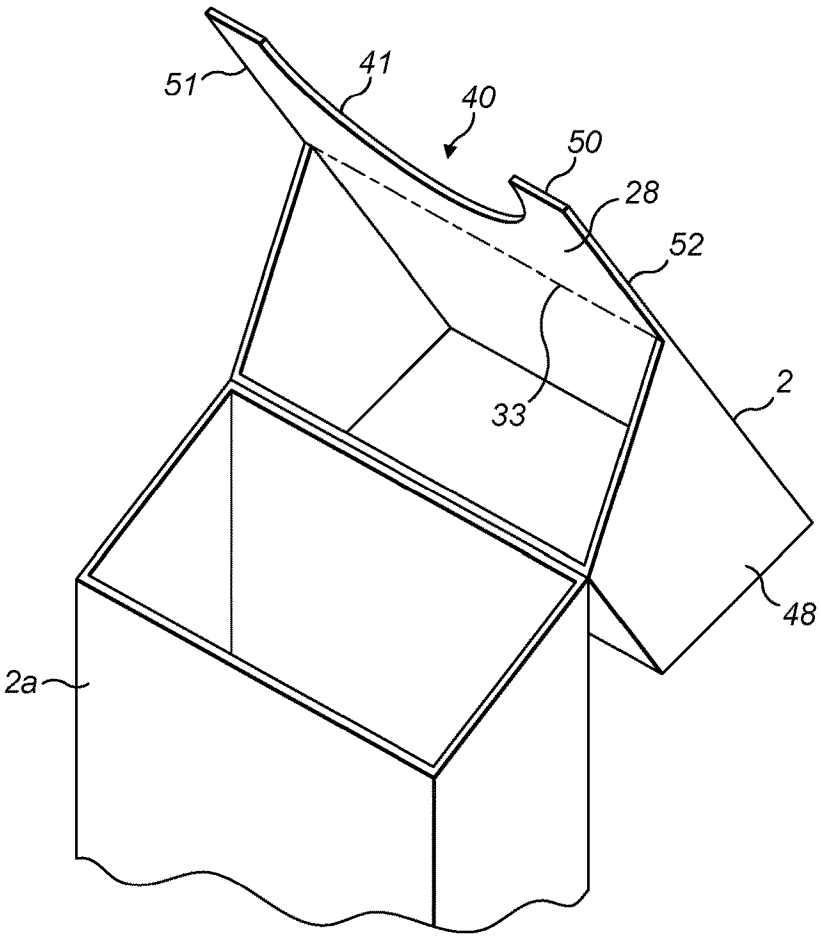
FIG. 7 shows a perspective view of a flap of FIG. 3 according to a second embodiment of the invention, comprising a profiled edge, before the flap is folded about a bottom edge of the front wall of the lid.

In a second embodiment of the invention there is a pack as described before wherein similar features retain the same reference numerals. Turning to FIGS. 7 and 8 the pack has been modified to include a profiled edge 41 on the lid front wall flap 31, where a portion of the lid front wall flap 31 has been cut away, forming a recess 40. This allows a portion of the inner surface 49 of the lid front wall 35 to be exposed 38 once the flap has been folded and adhered as described above.

The recess 40 can be formed by removing a portion of the lid front wall flap 31. The recess may be centrally located between side edges 51, 52. Alternatively, the recess 40 may be offset or there may be more than one recess, which may extend into the lid front wall flap 31 from the second and third side edges 51, 52.

The lid front wall flap 31 can include a number of recesses 40 along the first edge 50, or may also include at least one recess in either or both of the second 51 and third edges 52.

Figure 10:
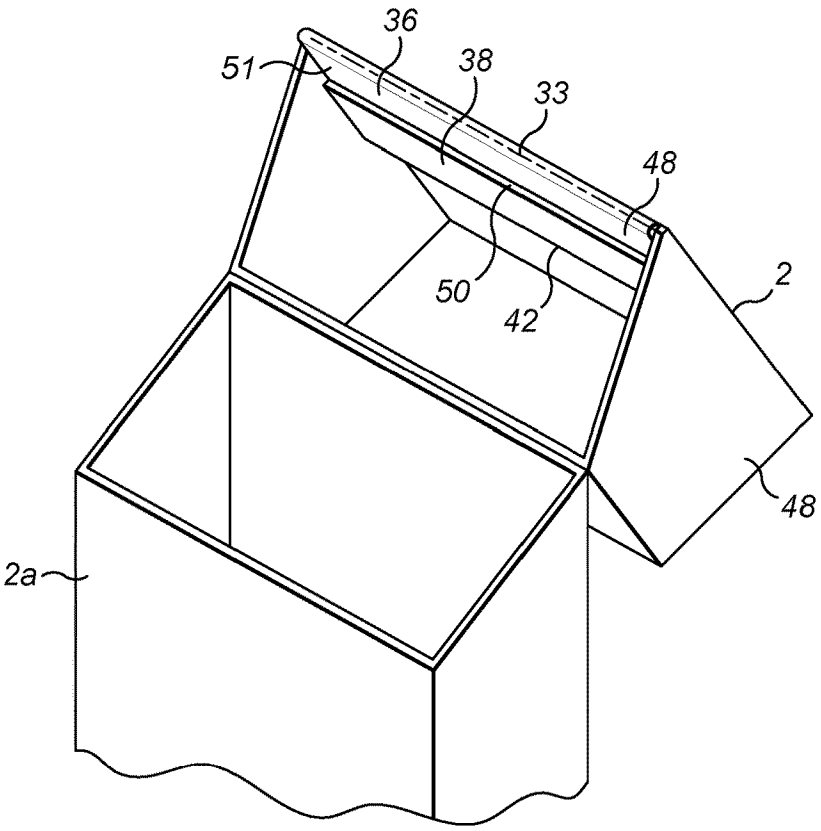
FIG. 10 shows a perspective view of a flap of FIG. 9 after the flap is folded about a bottom edge of the front wall of the lid.
Figure 9:
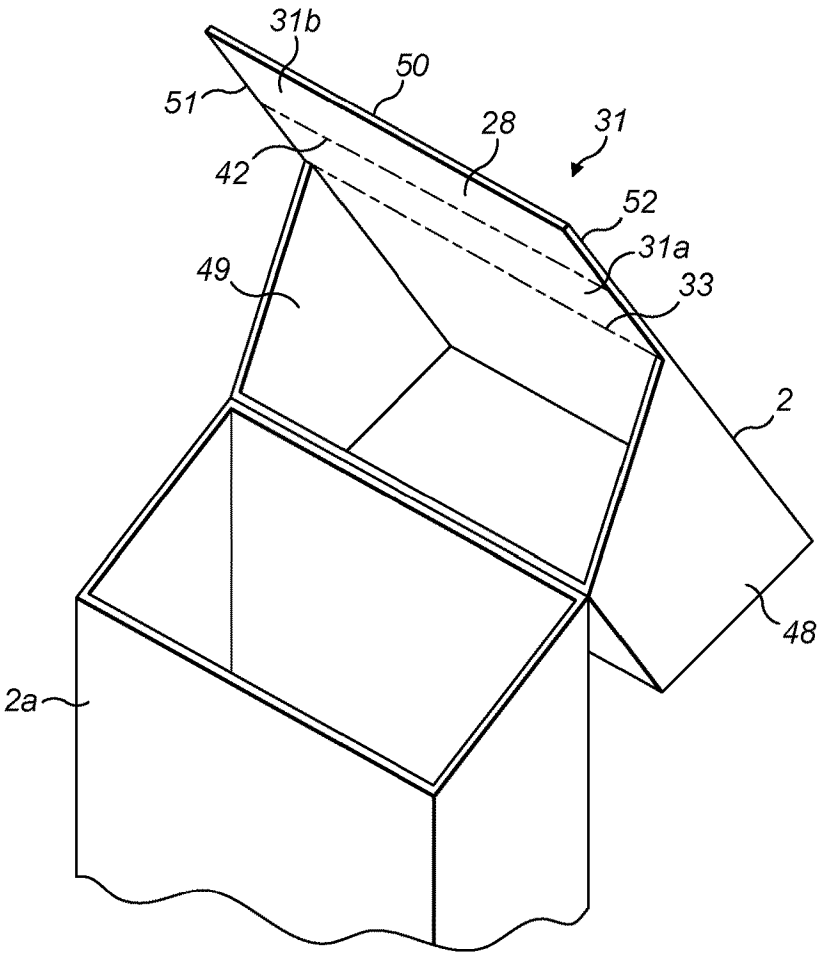
FIG. 9 shows a perspective view of a flap of FIG. 3 according to a third embodiment of the invention, comprising a fold, before the flap is folded about a bottom edge of the front wall of the lid.

A third embodiment of the invention is described with reference to FIGS. 9 and 10. In this embodiment, the pack 1 has been modified to provide the lid front wall flap 31 with first and second portions 31*a*, 31*b* separated by a fold 42. The first portion 31*a* extends from the fold line 33 to the fold 42, and the second portion 31*b* extends from the fold 42. The second portion 31*b* is folded back relative to the first portion 31*a* about the fold 42. A rear face of the first portion 31*a* is adhered to the inner surface 49 of the inner front face 24 of the lid 2. Folding back the second portion 31*b* exposes the inner surface formed by the second portion 31*b* to which the label 9 is attached. The front face of the second portion may be attached to the front face of the first portion using adhesive.

The fold 42 can be located substantially half way between the first edge 50 and the fold line 33, so that the first and second portions 31*a*, 31*b* are of equal size. However, the fold 42 may be positioned so that the first and second portions 31*a*, 31*b* are of unequal size. The fold 42 is substantially parallel to the fold line 33. However, it is not essential for the fold 42 to be parallel to the fold line 33, for example the flap 31 may have corners folded back to present two triangular second portions, extending from the first portion to expose an area of the inner surface 38. The corners having a fold line from the first edge 50 to the second edge 51, or from the first edge 50 to the third edge 52.

Figure 11:
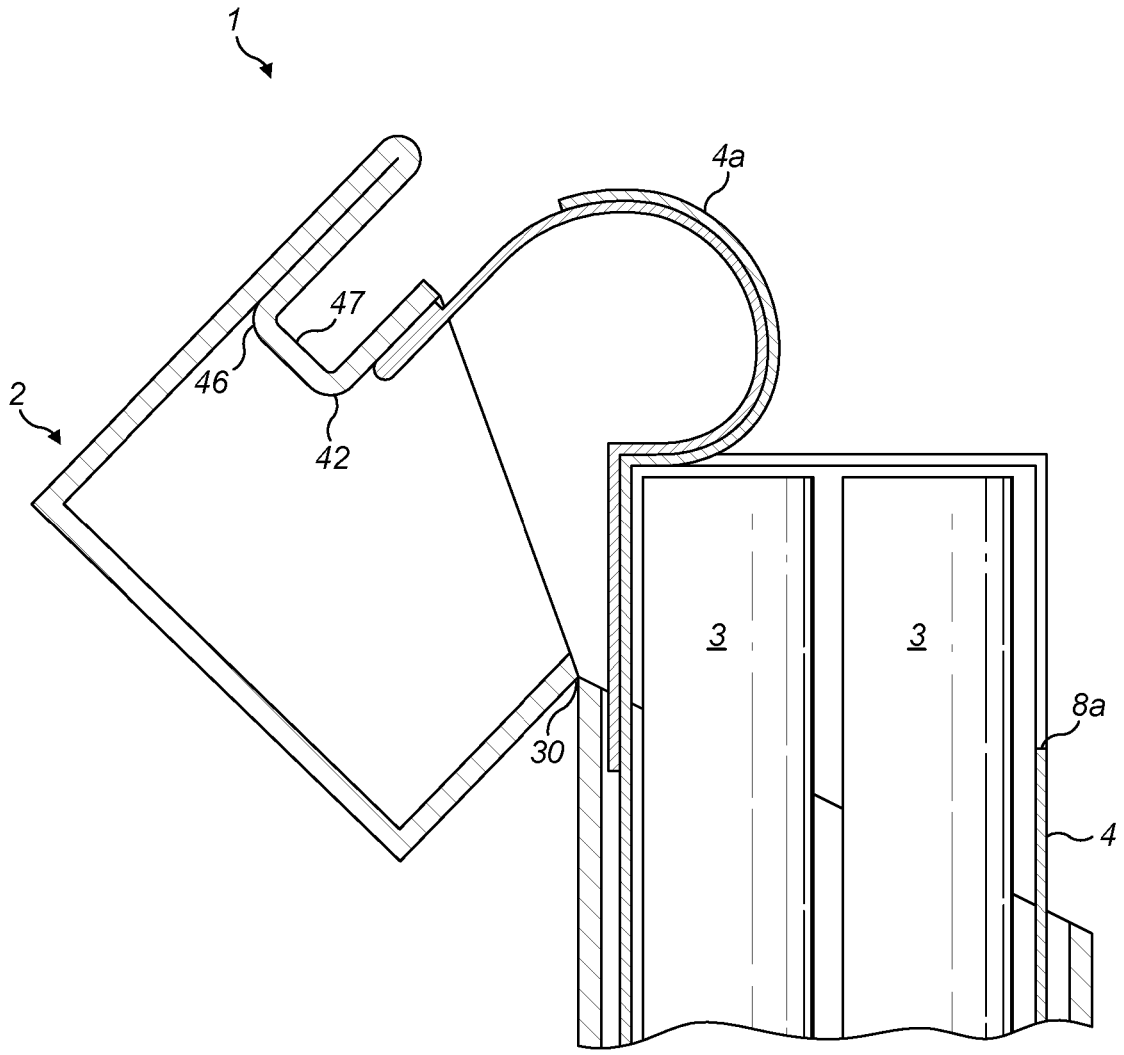
FIG. 11 shows a cross-sectional side elevation of an upper portion of the pack according to a fourth embodiment where the flap comprises a second fold, presenting a further portion to a user when the lid is open.
Figure 12:
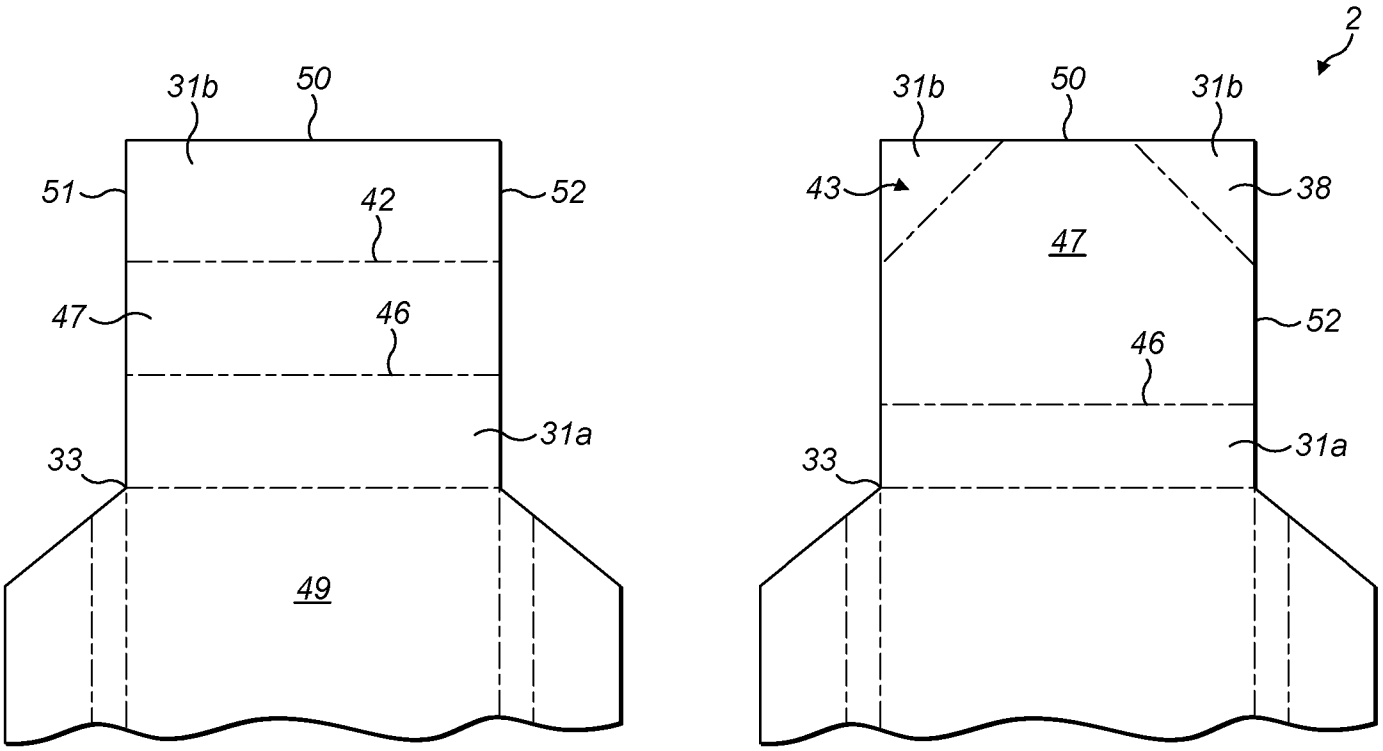
FIG. 12 shows an upper portion of two examples of a pack according to FIG. 11, where the flap comprises a second fold and a corner fold.

In a fourth embodiment as shown in FIGS. 11 and 12 the lid front wall flap 31 may also comprise a second fold 46, parallel to the first fold 42, to form an intermediate portion 47 between the first and second portions 31*a*, 31*b*. This intermediate portion 47 spaces the second portion 31*b* from the first portion 31*a*. The front face of the second portion, and the front face of the first portion, may be exposed to a consumer when the lid is opened and can provide a surface for printing information or other indicia. The intermediate portion may not be adhered to either the lid inner front face 24 or to the label.

One embodiment comprises a combination of the corner fold lines and the second fold 46. The label is adhered to the exposed inner surface 38 where the corners 43 have been folded back, as the lid 2 is opened the label 9 is simultaneously peeled back, the second fold 46 causing an intermediate portion 47 to be presented to a user. It can be appreciated that the flap may contain any combination of features described in the above embodiments.

A modified label may be used in any of the above described embodiments, which is adapted to suit the profile of the aperture 37 or apertures 37, the profiled edge or recess 40, or the folded portions. The profile of the tab of the label is configured to sit wholly or partially within the area of exposed inner surface 38. When the tab sits wholly within the exposed inner surface 38, i.e. the shape of the tab is adapted to suit the profile of the flap, the flap lies flat against the inner surface of the lid front wall, thereby ensuring good adhesion.

Figure 13:
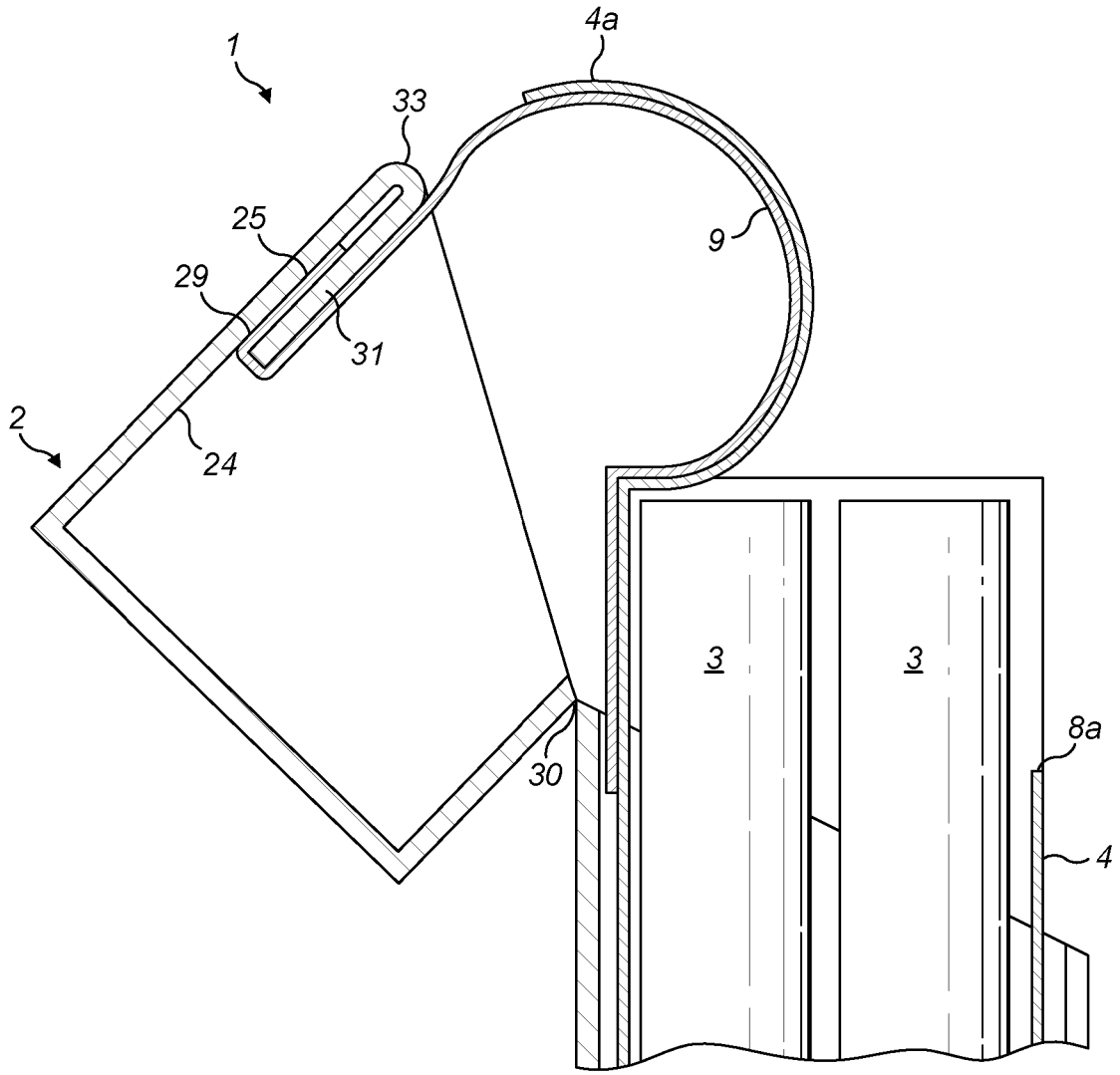
FIG. 13 shows a cross-sectional side elevation of an upper portion of the pack according to a fifth embodiment of the invention, where the label is adhered to the lid and the flap is adhered at least overlapping a portion of the label.

In a fifth embodiment of the invention there is a pack as described before wherein similar features retain the same reference numerals. Turning to FIG. 13 the label 9 has a region adjacent to its lowermost edge that is designated as a tab 25. An outer surface 29 of the tab 25 can be permanently adhered to the inner surface 24 of the lid 2.

Once the tab is attached to the inner surface of the lid the lid front wall flap 31 is then folded about the fold line 33, substantially 180 degrees and is adhered to the inner surface of the lid 24 at least partially overlapping the tab portion 25 of the label. At least a portion of the label is sandwiched in between the inner surface of the lid inner front face 24 and the inner surface of the flap 31.

Figure 16A:
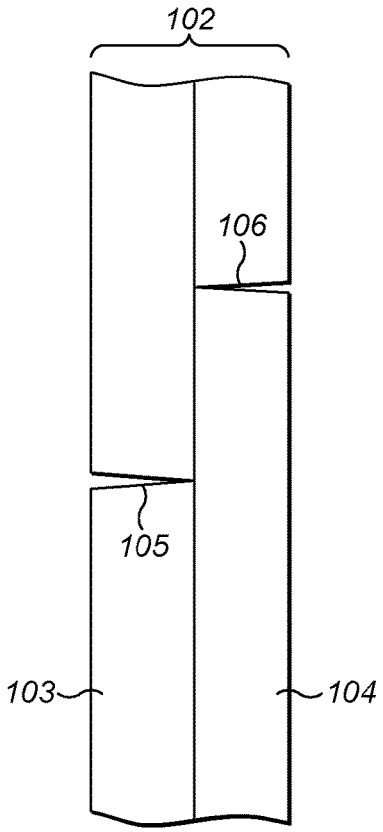
FIGS. 16A and 16B show partial cross-sections of the label and barrier of FIG. 14 made from different laminate materials.
Figure 16B:
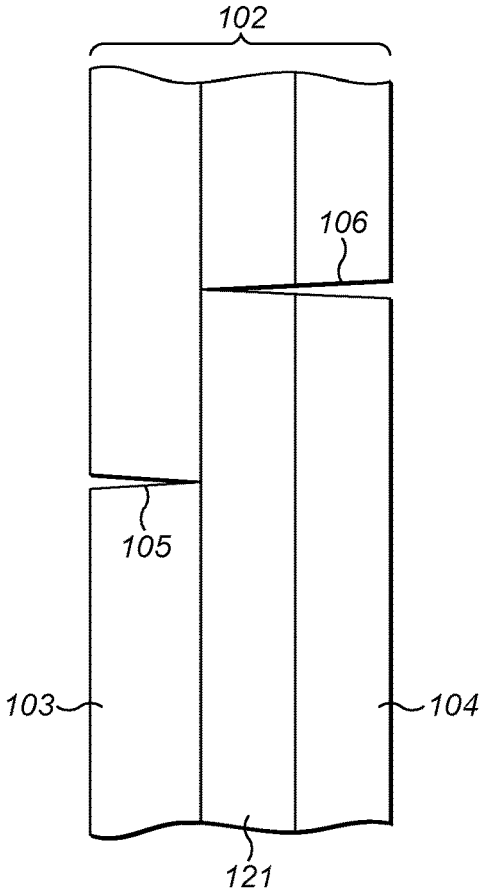

In one embodiment the label 9 and the barrier 4 are made from the same laminate material. FIGS. 16 to 16B show examples of this embodiment. A laminate 102 has an outer layer 103 having a first cut 105 that defines an outer layer region 108 bounded by said first cut and, an inner layer 104 having a second cut 106 that defines an inner layer region 112 bounded by said second cut 106. The inner layer region 112 lies within the outer layer region 108. A part of the outer layer region is attached to an inner surface of the lid 2 such that as the lid is rotated into its open position, the inner and outer layer regions are lifted causing the inner and outer layers to delaminate in a peripheral region 115 between the first and second cuts (105, 106) and an opening 6 to be created in the laminate.

FIG. 16B shows a further example of a laminate material as described above but with three layers. In the illustrated example, the outer layer 103 and the third layer 121 are bonded using a pressure-sensitive 're-stick' adhesive, and the inner layer 104 and the third layer 121 are bonded using a permanent adhesive. In an alternative example similar to that of FIG. 16B, the outer layer 103 and the third layer 121 are permanently bonded together, and the inner layer 104 and the third layer 121 are bonded together using pressure-sensitive adhesive. In this case, the first cut 105 is provided in the outer layer 103 and in the third layer 121, and the second cut 106 is provided in the inner layer 104 only. The first and second cuts 105, 106 are offset as previously described.

It will be appreciated that the laminate material 102 may have more than three layers bonded together in a similar manner to that described above, with the first and second cuts 105, 106 each provided in one or more of the layers. It can be envisaged that the integral label and barrier examples as described above can be combined with any of the previously described embodiments.

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solidsubstrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

Embodiments of the invention are described with reference to tobacco industry products, for example cigarettes. However, it will be appreciated that packs of the invention may alternatively be used for non-tobacco industry related products.

In order to address various issues and advance the art, the entirety of this disclosure shows by way of illustration various embodiments in which the claimed invention(s) may be practiced and provide a superior pack for tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A pack comprising:

a base containing a group of tobacco industry products wrapped in a barrier layer that comprises a section to define an extraction opening for the removal of tobacco industry products when the pack is in an open position, a lid attached to the base for rotation between the open position and a closed positions and comprising a lid front wall having an inner surface and a lid front wall flap folded relative to the lid front wall; and a label attached to said section and having a portion attached to the lid so that, when the lid is rotated into the open position, the section is lifted to open the extraction opening, wherein the lid front wall flap is shaped so that the portion of the label is attached to the inner surface of the lid front wall rather than to the lid front wall flap;

wherein the lid further comprises facing side walls separated by the lid front wall and the portion of the label attached to the lid comprises a tab having a width which is less than a width of the lid front wall extending between the facing side walls, and wherein the tab is at least partially surrounded by the lid front wall flap.

2. A pack according to claim 1, wherein the tab is attached to the inner surface of the lid front wall so that a portion of the lid front wall flap extends between the tab and each facing side wall of the lid.

3. A pack according to claim 2, wherein the tab is completely surrounded by the lid front wall flap.

4. A pack according to claim 3, comprising an aperture in the lid front wall flap and the portion of the label is attached to the inner surface of the lid front wall through the aperture.

5. A pack according to claim 1, comprising a recess extending from an edge of the lid front wall flap, the tab being received in the recess and attached to the inner surface of the lid front wall.

6. A pack according to claim 5, wherein the tab is received in the recess and is attached to the inner surface of the lid front wall so that a portion of the lid front wall flap extends between the tab and each facing side wall of the lid.

7. A pack according to claim 5, wherein the tab is received in the recess and is attached to the inner surface of the lid front wall so that a portion of the tab extends between the lid front wall flap and each facing side wall of the lid.

8. A pack according to claim 1, wherein the tab is separated from the remainder of the label by a fold-line.

9. A pack according to claim 1, wherein the base and lid are formed from a sheet of board having a metallised surface layer.

10. A pack according to claim 9, wherein an opposing surface of the board does not have a metallised surface layer, and the inner surface of the lid front wall to which the label is attached is said opposing surface.

11. A pack according to claim 1, wherein the label comprises an inner surface attached to the section, and an outer surface, formed by the tab, attached to the lid.

12. A pack according to claim 1, wherein the lid front wall flap extends over said portion of the label attached to the inner surface of the lid front wall.

13. A pack according to claim 12, wherein the lid front wall flap is attached to said portion.

14. A pack according to claim 12, wherein the lid comprises facing side walls separated by the lid front wall and the portion of the label attached to the lid comprises a tab having a width which is less than a width of the lid front wall flap extending between the facing side walls.

15. A pack according to claim 12, wherein the lid front wall flap is attached to the tab and to the lid front wall.

16. A pack according to claim 12, wherein the label comprises a peripheral portion that extends beyond the section, said peripheral portion being attached to the barrier layer with reusable adhesive such that the peripheral portion of the label is peeled away from the barrier layer when the lid is opened and is repositioned to reseal the barrier material when the lid is closed.

17. A pack according to claim 16, wherein the barrier layer is formed from a laminate material comprising first and second layers, the label being formed from the second layer.

18. A pack according to claim 12, wherein the label comprises an inner surface attached to the section, and an outer face of the label is attached to the lid.

* * * * *